US006904918B2

(12) United States Patent
Snaidr et al.

(10) Patent No.: US 6,904,918 B2
(45) Date of Patent: Jun. 14, 2005

(54) LOW SIDESTREAM SMOKE CIGARETTE WITH NON-COMBUSTIBLE TREATMENT MATERIAL

(75) Inventors: Stanislav M. Snaidr, Mississauga (CA); E. Robert Becker, Wayne, PA (US)

(73) Assignee: Rothmans, Benson & Hedges Inc., North York (CA)

( * ) Notice: Subject to any disclaimer, the term of this patent is extended or adjusted under 35 U.S.C. 154(b) by 0 days.

(21) Appl. No.: 10/866,719

(22) Filed: Jun. 15, 2004

(65) Prior Publication Data

US 2005/0000530 A1 Jan. 6, 2005

Related U.S. Application Data

(62) Division of application No. 09/954,437, filed on Sep. 18, 2001, now Pat. No. 6,810,884.
(60) Provisional application No. 60/233,440, filed on Sep. 18, 2000.

(51) Int. Cl.[7] ..... A24D 3/14
(52) U.S. Cl. ..... 131/334; 131/365; 131/360; 131/207; 162/139; 162/181.5
(58) Field of Search ..... 131/334, 365, 131/360, 207, 203, 191, 331, 349; 162/139, 181.5

(56) References Cited

U.S. PATENT DOCUMENTS

| | | | |
|---|---|---|---|
| 1,211,071 | A | 1/1917 | Brown |
| 1,862,679 | A | 6/1932 | Holsman |
| 2,755,207 | A | 7/1956 | Frankenburg |
| 3,220,418 | A | 11/1965 | Cohn |
| 3,693,632 | A | 9/1972 | Tolman |
| 3,827,444 | A | 8/1974 | Khan |
| 3,886,954 | A | 6/1975 | Hannema et al. |

(Continued)

FOREIGN PATENT DOCUMENTS

| | | |
|---|---|---|
| CA | 604895 | 9/1960 |
| CA | 835684 | 3/1970 |
| CA | 1239783 | 8/1988 |
| CA | 1259008 | 9/1989 |
| EP | 0 107 471 | 5/1984 |
| EP | 0 658 320 | 12/1994 |
| EP | 0 740 907 | 11/1996 |
| FR | 1583284 | 10/1969 |
| GB | 928089 | 6/1963 |
| GB | 1435504 | 5/1976 |
| GB | 2094130 | 9/1982 |
| WO | WO 95/34226 | 12/1995 |
| WO | WO 96/22031 | 7/1996 |
| WO | WO 98/16125 | 4/1998 |
| WO | WO 99/53778 | 10/1999 |

*Primary Examiner*—Dionne A. Walls
(74) *Attorney, Agent, or Firm*—Banner & Witcoff, Ltd.

(57) ABSTRACT

A low sidestream smoke cigarette comprises a conventional tobacco rod and a non-combustible treatment material for the rod. The treatment material has a porosity less than about 200 Coresta units and a sidestream smoke treatment composition. The treatment composition comprises, in combination, an oxygen storage and donor metal oxide oxidation catalyst and an essentially non-combustible finely divided porous particulate adjunct for said catalyst. In addition, the invention provides a low sidestream smoke cigarette unit that comprises a cigarette with conventional cigarette paper surrounding a conventional tobacco rod and a non-combustible treatment material surrounding and being substantially in contact with the conventional cigarette paper. The non-combustible treatment material comprises a sidestream smoke treatment composition, wherein the non-combustible treatment material has a porosity less than about 200 Coresta units and the treatment composition comprises, in combination, an oxygen storage and donor metal oxide oxidation catalyst and an essentially non-combustible finely divided porous particulate adjunct for said catalyst.

36 Claims, 2 Drawing Sheets

U.S. PATENT DOCUMENTS 3,916,916 A 11/1975 Bramucci
4,108,151 A 8/1978 Martin et al.
4,182,348 A 1/1980 Seehofer et al.
4,225,636 A 9/1980 Cline et al.
4,231,377 A 11/1980 Cline et al.
4,248,251 A 2/1981 Bryant, Jr. et al.
4,420,002 A 12/1983 Cline
4,433,697 A 2/1984 Cline et al.
4,450,847 A 5/1984 Owens
4,461,311 A 7/1984 Mathews et al.
4,561,454 A 12/1985 Guess
4,624,268 A 11/1986 Baker et al.
4,637,410 A 1/1987 Luke
4,638,819 A 1/1987 Ikeda
4,685,477 A 8/1987 Valdez
4,805,644 A 2/1989 Hampl, Jr. et al.
4,878,507 A 11/1989 Case et al.
4,915,117 A 4/1990 Ito
4,915,118 A 4/1990 Kaufman et al.
5,040,551 A 8/1991 Schlatter et al.
5,105,838 A 4/1992 White et al.
5,137,034 A 8/1992 Perfetti et al.
5,159,940 A 11/1992 Hayward et al.
5,220,930 A 6/1993 Gentry
5,271,419 A 12/1993 Arzonico et al.
5,386,838 A 2/1995 Quincy, III et al.
5,462,073 A 10/1995 Bowen et al.
5,592,955 A 1/1997 Keritsis
5,709,228 A 1/1998 Cohen et al.
5,944,025 A 8/1999 Cook et al.
6,810,884 B2 * 11/2004 Snaidr et al. ..... 131/334

* cited by examiner

LOW SIDESTREAM SMOKE CIGARETTE WITH NON-COMBUSTIBLE TREATMENT MATERIAL

This application is a divisional of U.S. patent application Ser. No. 09/954,437 Sep. 18, 2001, now U.S. Pat No. 6,810,884 which in turn claims benefit of the Sep. 18, 2000 filing date of the U.S. provisional application Ser. No. 60/233,440 filed on Sep. 18, 2000 by the same inventors entittled "The Use Of An Oxygen Metal Oxide Catalyst To Reduce Cigarette Sidestream Smoke", both of which applications are expressly incorporated entirely herein by reference.

FIELD OF THE INVENTION

The invention relates to a non-combustible cigarette sidestream smoke treatment material. The non-combustible treatment material, either substituted for conventional cigarette paper or used in combination with a cigarette having conventional cigarette paper, provides a low sidestream smoke emitting cigarette unit.

BACKGROUND OF THE INVENTION

Smoking of tobacco products produces three types of smoke, namely mainstream smoke, exhaled smoke and sidestream smoke, particularly as it would relate to the smoking of cigarettes. Filter materials abound for use in removing sidestream smoke and exhaled smoke in somewhat confined areas where people might be smoking. It is generally understood that sidestream smoke accounts for the majority of smoke emitted during the smoking process. There has therefore been significant interest in reducing sidestream smoke and this might be accomplished by one or more of the following techniques:

i) alter the tobacco composition and packing characteristics of the tobacco rod charge in the cigarette or cigar;

ii) alter the cigarette paper wrapping of the cigarette or cigar;

iii) alter the diameter of the cigarette as well as its tobacco composition and/or provide a device on the cigarette or cigar to contain and/or control sidestream smoke emissions.

Various cigarette tobacco and cigarette paper designs have been suggested with a view to reducing sidestream smoke. In one way or another these designs affect the free-burn rate of the cigarette or cigar resulting in an extinguishment of the lit cigarette or cigar when left idle over an extended period of time. Such designs include a selection of tobacco blends, smaller cigarette diameters, densities and multiple layers of cigarette tobacco in the tobacco charge. Such selected designs can appreciably retard the free-burn rate of the cigarette and hence, increase the number of puffs obtained per unit length of cigarette. Either in combination with tobacco selection and/or construction or independently of the tobacco make up, various cigarette paper compositions can also affect free-burn rate of the cigarette. Such paper compositions include the use of chemicals to retard free-burn rate, chemicals to reduce sidestream smoke, multiple wrappings of different types of cigarette paper of the same or different characteristics and reduction of air permeability. See for example, Canadian Patents 1,239,783 and 1,259,008 and U.S. Pat. Nos. 4,108,151; 4,225,636; 4,231,377; 4,420,002; 4,433,697; 4,450,847; 4,461,311; 4,561,454; 4,624,268; 4,805,644; 4,878,507; 4,915,118; 5,220,930 and 5,271,419 and U.K. patent application 2,094,130. Cigarettes of smaller diameter have also been tried such as described in U.S. Pat. No. 4,637,410.

Various devices have been provided which contain the cigarette, primarily for purposes of preventing accidental fires. They may or may not at the same time include various types of filters to filter and thereby reduce the amount of sidestream smoke. Examples of such devices are shown in U.S. Pat. Nos. 1,211,071; 3,827,444; 3,886,954 and 4,685,477.

Further, various types of cigarette holders have been made available which serve the primary feature of minimizing staining of the smoker's fingers. Such devices may be connected to the cigarette tip and/or mounted on the cigarette, such as shown in U.S. Pat. No. 1,862,679. Other types of cigarettes which are enclosed in wrappers which are perforated in one way or another to provide for safety features and/or control of sidestream smoke are described in Canadian Patent 835,684 and U.S. Pat. Nos. 3,220,418 and 5,271,419.

Devices which are mountable on the cigarette and which may be slid along the cigarette to control rate of combustion and hence free-burn rate are described in U.K. patent 928,089; U.S. Pat. No. 4,638,819 and International application WO 96/22031. U.K. patent 928,089 describes a combustion control device for cigarettes by limiting the flow of air to the cigarette burning ember. By retarding combustion of the cigarette, it is suggested that only half of the conventional amount of tobacco need be incorporated in the cigarette and result thereby in a shorter cigarette. The air flow limiting device may be provided by an array of apertures in the device with variable opening or by crimped portions in the device providing longitudinal openings along part of the cigarette. U.S. Pat. No. 4,638,819 describes a ring which is placed on the cigarette and slid therealong during the smoking process to control the free-burn rate of the cigarette and reduce sidestream smoke. The ring is of solid material, preferably metal, which causes considerable staining and due to variable cigarette diameters cannot reliably provide the desired degree of sidestream smoke reduction and extinguishing times.

Other systems, which have been designed to control sidestream smoke, are described in International application WO 95/34226 and U.S. Pat. Nos. 4,685,477; 5,592,955 and 5,105,838. These references describe various tubular configurations in which a tobacco element is placed in an attempt to minimize cigarette sidestream emission.

Various types of ceramic constituents have been used in cigarette structures including insulating tubes for cigarettes as well as insulating tubes for cigarette smoke aerosol generating devices. U.S. Pat. No. 4,915,117 describes a thin sheet of ceramic, which is substituted for cigarette paper to reduce organic substances given off during the burning of conventional cigarette paper. Insulated ceramic sleeves are described in U.S. Pat. Nos. 5,105,838 and 5,159,940. U.S. Pat. No. 5,105,838 describes a cigarette unit having a thin tobacco rod of a circumference of about 12.5 mm. The insulating ceramic sleeve has low heat conductivity and is porous. In order to achieve reduction in sidestream smoke emissions from the burning tobacco rod, the free-burn rate is reduced by the use of a low porosity wrap over the porous ceramic element where the wrap has a permeability less than about 15 Coresta units.

U.S. Pat. No. 5,592,955 describes a porous shell which is re-usable and non-combustible for concealing and retaining a rod of smokable material before, during and after smoking. Reduction of sidestream smoke emitted from this device is provided by an outer wrap for the shell which has a permeability of less than 40 Coresta units where the shell has a radial thickness of about 0.25 mm to 0.75 mm. The wrap controls the overall porosity of the device and thereby controls free-bum rate of the cigarette and reduces sidestream smoke developed during intervals between puffs. The device includes an air permeable cap at the open end of the tube. The non-combustible shell may include bands of metal which act as heat sinks to reduce the free-burn rate of the tobacco rod.

Catalytic materials have been used in smoking devices such as in the tobacco and particularly in cigarette smoke filters to convert mainstream smoke constituents usually by oxidation as taught in U.S. Pat. No. 3,693,632; U.K. Patent 1 435 504 and published European patent applications EP 107 471 and EP 658 320. Catalysts have also been included in cigarette papers for wrapping tobacco such as described in Canadian Patent 604,895 and U.S. Pat. Nos. 4,182,348 and 5,386,838. Adsorptive materials, such as zeolites have been incorporated in the tobacco as well as the cigarette filter. Zeolites adapted for this use are described in published European patent application EP 740 907, where such zeolites have pore sizes within the range of 5 to 7 Å.

The applicant has made a considerable contribution in this area, as described in its U.S. Pat. Nos. 5,462,073 and 5,709,228 and International applications WO 96/22031; WO 98/16125 and WO 99/53778. The non-combustible systems described in each of these published patents and applications are directed towards cigarette sidestream smoke control systems. In particular, International application WO 99/53778 is directed to a cigarette sidestream smoke treatment material which is based on the combination of the material having a highly porous structure well in excess of 200 Coresta units and an oxygen storage component with oxygen donating ability. Although these various devices have met with varying degrees of success in controlling sidestream smoke emissions from a burning cigarette, the various embodiments of this invention provide a non-combustible smoke treatment material that is capable of treating cigarette tobacco sidestream smoke in a surprisingly superior manner, without the need for a highly porous material to encourage the conventional free-burn rate. Specifically, this invention is directed to a more easily manufactured, non-combustible sidestream smoke treatment material having a porosity less than about 200 Coresta units.

SUMMARY OF THE INVENTION

The invention provides for a significant reduction in sidestream smoke in its various applications. Surprisingly, it has been found that such reduction in sidestream smoke can be achieved by using a non-combustible treatment material having a porosity less than about 200 Coresta units and preferably less than 30 Coresta units. The treatment material has a sidestream smoke treatment composition comprising in combination, an oxygen storage and donor metal oxide oxidation catalyst and an essentially non-combustible finely divided porous particulate adjunct for the catalyst.

The non-combustible treatment material may be dimensionally formed into a sheet, wrapper, paper or the like. This formed treatment material may be shaped into a tube placed on and in substantial contact with the conventional cigarette paper of a cigarette, the material may be wrapped over and in substantial contact with the conventional cigarette paper of a cigarette or the material may be substituted for the conventional cigarette paper itself of a cigarette. The non-combustible material provides acceptable free-burn rates of a conventional cigarette while minimizing or virtually eliminating visible sidestream smoke.

The adjunct for the catalyst may be any suitable essentially non-combustible particulate material such as clays, carbon materials such as milled porous carbon fibres, mineral based materials such as metal oxides and metal oxide fibres, ceramics such as milled porous ceramic fibres and high surface area porous particles. In this respect, the catalyst adjunct is most preferably an essentially non-combustible high surface area sorptive material such as activated carbon or zeolites. In a most preferred embodiment of the invention, the sorptive materials are zeolites and in particular, hydrophobic zeolites. The zeolites are especially preferred when used in combination with a cerium based catalyst.

The sidestream smoke treatment composition may be applied in various ways. The composition may be used as a filler in the manufacture of the non-combustible treatment material, impregnated in the non-combustible treatment material, or as a coating(s) or a layer(s) on the exterior or interior of the non-combustible treatment material. The resultant low sidestream smoke treatment material may have a range of porosities less than about 200 Coresta units. Preferred porosities are usually lower and in the range of about 0.5 to 30 Coresta units. It is appreciated that the treatment material may be used as a multiple wrap. The material may be applied as an outer wrap over a cigarette having conventional cigarette paper. The sidestream smoke treatment composition may be applied as a coating on both or either side of a wrap for a multiple—usually a double-wrapped cigarette, or impregnated into the material, or may be incorporated as a filler in the manufacture of the material for single or multiple wraps of cigarette paper. In a double wrap arrangement, the sidestream smoke treatment composition may in one embodiment be sandwiched between two wraps. In a further double wrap embodiment, the sidestream smoke treatment composition may be coated on the side of the wrap adjacent the tobacco rod where different loadings of the composition sandwiched in between the two wraps may be provided. In still a further double wrap embodiment, the sidestream smoke treatment composition may be coated onto both sides of the wrap placed on the tobacco rod, where different loadings may be provided. A second wrap may be used as a further wrap thereover. It has been found that in order to optimize sidestream smoke reduction, the catalyst and adjunct are used in combination. The two components may be co-mingled as a filler, for example, in the manufacture of the non-combustible treatment material. Alternatively, when used as a coating, the catalyst and the adjunct are also co-mingled, usually as a slurry, and applied as such to non-combustible treatment material. In respect of the preferred embodiments, and in particular, the combined use of cerium with zeolite, the materials may be applied as individual contacting thin layers to develop a multi-layer coating. Such layers may be of a thickness usually less than that of conventional cigarette paper and due to their intimate contacting nature, function as though they were combined and co-mingled.

In accordance with other aspects of the invention, a low sidestream smoke cigarette comprises a conventional tobacco rod and a non-combustible treatment material for said rod, wherein the treatment material has a porosity less than about 200 Coresta units and a sidestream smoke treatment composition, comprising, in combination, an oxygen storage and donor metal oxide oxidation catalyst and an essentially non-combustible finely divided porous particulate adjunct for the catalyst.

In accordance with another aspect of the invention, a low sidestream smoke cigarette unit comprising a cigarette with conventional cigarette paper surrounding a conventional tobacco rod and a non-combustible treatment material surrounding and being substantially in contact with the conventional cigarette paper, the non-combustible treatment material comprising a sidestream smoke treatment composition, wherein the non-combustible treatment material has a porosity less than about 200 Coresta units and the treatment composition comprises, in combination, an oxygen storage and donor metal oxide oxidation catalyst and an essentially non-combustible finely divided porous particulate adjunct for the catalyst.

In accordance with still another aspect of the invention is a low sidestream smoke cigarette comprising a conventional tobacco rod and a non-combustible treatment material for said rod, wherein said treatment material has a porosity less than about 200 Coresta units and a sidestream smoke treatment composition comprising, in combination, an oxygen storage and donor metal oxide oxidation catalyst and an essentially non-combustible finely divided porous zeolite adjunct for said catalyst.

In accordance with a further aspect of the invention, a furnish composition for use in making a non-combustible treatment material, with a porosity less than about 200 Coresta units, for reducing sidestream smoke emitted from a burning cigarette, the furnish composition comprising, in combination, an oxygen storage and donor metal oxide oxidation catalyst and an essentially non-combustible finely divided porous particulate adjunct for the catalyst.

In accordance with another aspect of the invention, a slurry composition for application to a non-combustible wrapper to produce a non-combustible treatment material with a porosity less than about 200 Coresta units, for reducing sidestream smoke emitted from a burning cigarette, the slurry composition comprising, in combination, an oxygen storage and donor metal oxide oxidation catalyst and an essentially non-combustible finely divided porous particulate adjunct for said catalyst.

In accordance with another aspect of the invention, a method for reducing sidestream smoke emitted from a burning cigarette, comprises treating sidestream smoke with a non-combustible treatment material having a porosity less than about 200 Coresta units, the treatment composition comprising, in combination, an oxygen storage and donor metal oxide oxidation catalyst and an essentially non-combustible finely divided porous particulate adjunct for said catalyst.

In accordance with another aspect of the invention, a non-combustible cigarette material for use on a smokable tobacco rod of a cigarette for reducing sidestream smoke emitted from a burning cigarette, the material having a porosity less than about 200 Coresta units and a sidestream smoke treatment composition comprising, in combination, an oxygen storage and donor metal oxide oxidation catalyst and an essentially non-combustible finely divided porous particulate adjunct for the catalyst.

In accordance with another aspect of the invention, a method for reducing sidestream smoke emitted from a burning cigarette, comprising treating sidestream smoke with a non-combustible treatment material for a conventional tobacco rod, wherein the treatment material has a porosity less than about 200 Coresta units and the treatment composition comprises, in combination, an oxygen storage and donor metal oxide oxidation catalyst and an essentially non-combustible finely divided porous particulate adjunct for the catalyst. In accordance with a further aspect of the invention, a method for reducing sidestream smoke emitted from a burning cigarette, comprising treating sidestream smoke with a non-combustible treatment material surrounding and being substantially in contact with conventional cigarette paper, the conventional cigarette paper surrounding a smokable tobacco rod, wherein the treatment material has a porosity less than about 200 Coresta units and the treatment composition comprises, in combination, an oxygen storage and donor metal oxide oxidation catalyst and an essentially non-combustible finely divided porous particulate adjunct for the catalyst.

In order to facilitate the description of this invention the term tobacco rod or tobacco charge shall be used in referencing cigarette, cigars, cigarillo, tobacco rod in a wrapper, a tobacco plug, wrapped tobacco or the like. It is also understood that when the term cigarette is used, it is interchangeable with cigar, cigarillo and other rod shaped smoking products. Conventional tobacco rods encompasses tobacco compositions normally used in smokable cigarettes. These rods are to be distinguished from tobacco components used in aerosol cigarettes.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
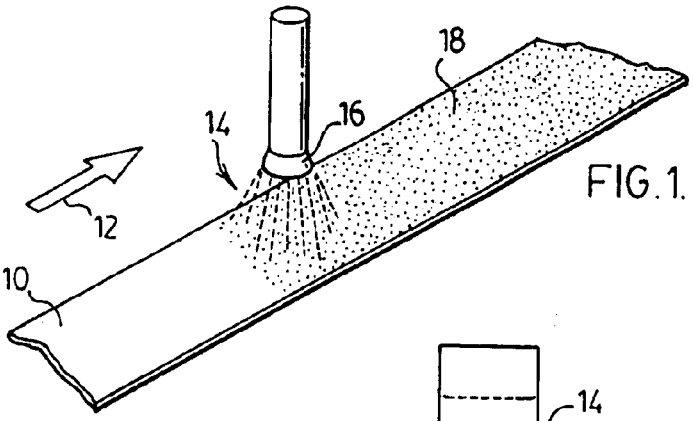
FIG. 1 is a schematic view of a spraying technique for applying a treatment composition to a non-combustible paper.

The non-combustible sidestream smoke treatment material, having a porosity that is less than about 200 Coresta units, and as applied to tobacco smoke treatment in accordance with this invention, provides a very significant unexpected advantage, particularly when applied to cigarette sidestream smoke. The treatment material may be in the shape of a tube placed on and in substantial contact with the cigarette paper of a cigarette, the material may be wrapped over and in substantial contact with the cigarette paper of a cigarette or the material may be substituted for the cigarette paper itself of a cigarette. When the treatment material is in the shape of a tube placed on and in substantial contact with cigarette paper of a cigarette or the material is wrapped over and in substantial contact with cigarette paper of a cigarette, this arrangement permits the use of a conventional cigarette and when smoked, burns at conventional free-burn rates. Reference to a normal or conventional cigarette implies commercially available cigarettes having tobacco rods of conventional packing densities with conventional grades of tobacco, fillers, puffed tobacco and the like. The tobacco rod is encompassed in a conventional cigarette paper having the usual porosity in the range of about 5 to about 50 Coresta units and sometimes as high as 110 to 120 Coresta units.

A conventional cigarette filter may be either attached to the cigarette in the usual way, or alternatively, a filter may be provided in conjunction with the treatment material in tubular form which encases the tobacco rod with conventional cigarette paper. Conventional cigarettes have a conventional free-burn rate of about 3 to about 5 mm/min given conventional tobacco densities of about 0.20 to about 0.26 g/cc. Conventional cigarettes, at least in North America, have a circumference of about 20 to 30 cm, usually about 23 to 27 mm and a tobacco rod length of at least about 40 mm and preferably of about 55 mm, about 64 mm and about 74 mm, which has acceptable draw resistance. The cigarette filter usually has a length of about 15 to about 35 mm.

The cigarettes may be tailor made smokable cigarettes or may be the non-smokable type of tobacco rod. According to one aspect of the invention, the non-smokable type is rendered smokable when cigarette paper is applied thereto to form a smokable cigarette or the paper is on the inside of the treatment material in the form of a tube and the tobacco rod is inserted therein.

When the treatment material replaces the cigarette paper itself of a cigarette, this arrangement permits the use of the conventional cigarette described above without the conventional cigarette paper itself and when smoked, burns at conventional free-burn rates. For example, the normal or conventional cigarette has tobacco rods of conventional packing densities with conventional grades of tobacco, fillers, puffed tobacco and the like. The tobacco rod is encompassed in the treatment material. A conventional cigarette filter is attached to the cigarette in the usual way. The cigarette, at least in North America, would preferably have a circumference of about 20 to 30 cm, more preferably about 23 to 27 mm and a tobacco rod length of at least about 40 mm and preferably of about 55 mm, about 64 mm and about 74 mm, which has acceptable draw resistance. The cigarette filter preferably has a length of about 15 to about 35 mm.

The treatment material in view of its proximity to the burning coal is able to provide sidestream smoke control in a very compact structure. Previously, cigarette units which provided for conventional free-burn rate were extremely bulky due to a large cavity defined within a tube which was spaced from the cigarette and did not in any way resemble a normal or conventional size cigarette. Attempts to control sidestream smoke with more compact conventional sized units usually resulted in the use of thinner cigarettes so as to provide a space between tube and cigarette. This might necessitate the smoker having to change brands in order to use the device and can also change the taste and flavour of the cigarette.

The treatment material of this invention has the advantage, particularly in respect of cigarettes, which allows a smoker to use the cigarette of their choice in the tubular structure or buy their favorite cigarette wrapped in the material of this invention, with or without conventional cigarette paper. Although the treatment material may be used in conjunction with other forms of smoking products such as pipes and as well in filter devices for general filtration of tobacco smoke from air, the most significant application is in respect of cigarettes and cigars and other rod shaped smoking products. The treatment material may be wrapped onto cigarettes by standard cigarette making machines, the treatment material may be used in place of the conventional cigarette paper when cigarettes are made by standard cigarette making machines or the treatment material may be formed into a tube into which the cigarette is inserted where the tube interior contacts the cigarette. The treatment material permits smoking of conventional cigarettes in the usual customary way while providing conventional taste and flavour and minimal, if any, off odour. These features are particularly realized by allowing the cigarette to burn at its conventional free-burn rate. The treatment material is non-combustible, readily disposable and friendly to the environment since it may be made from inert materials such as ceramics, clays and other suitable binders and sheet reinforcement materials. The treatment material may be designed to have an external temperature which is relatively low and provides thereby higher safety characteristics. The assembled cigarette unit is lightweight and at the open end is readily lit. Although not preferred, the tube may be adapted for reuse by permitting the cigarette to be reinserted in the tube in place of the cigarette that has been smoked.

The efficacy of the treatment material is enhanced by being very close to or placed in contact with the cigarette paper or tobacco itself. The treatment material, by virtue of its construction, is most preferably positioned substantially adjacent the burning coal of a cigarette to intercept, capture by adsorption or absorption or both, and treat various components of sidestream smoke which have left the burning coal and is clear of the tobacco rod or cigarette paper. It is appreciated that only components which have sufficient affinity for the material are sorbed. Other materials, such as very volatile gases may pass through the material without being sorbed. However, such gases may be oxidized in the reaction zone of the material and in the presence of catalyst such oxidation reactions are expedited. The treatment material, in the shape of a tube placed on and in substantial contact with cigarette paper of a cigarette, wrapped over and in substantial contact with cigarette paper of a cigarette or substituted for the cigarette paper itself of a cigarette, permits the cigarette to burn in the conventional manner without combustion of the treatment material. It is appreciated however, that the treatment material may be structured in a way that its structural strength is weakened during the smoking process to permit crushing of the cigarette before the smoker is finished.

Also with modifications, the tubular member could be used in conjunction with "roll-your-own" style of cigarettes which are normally sold in non-smokable form but when inserted in the tube become smokable. For example, the treatment material in sheet form could have cigarette paper applied to an inside surface thereof, formed into a tube and with the non-smokable tobacco rod, such as, described in Canadian Patent 1,235,039, inserted into the tube, becomes a smokable cigarette unit. The treatment material may also be used on non-conventional cigarettes which, for example, may have modified cigarette papers which reduce free-burn of the cigarette. Although, cigarettes with reduced free-burn rates are not preferred, there may in certain circumstances be a need for such a cigarette unit, even though taste and flavour may be different.

In accordance with an embodiment of the invention, the first active component in the treatment material is an adjunct (sorbent material) capable of selectively sorbing components of the sidestream smoke emitted from a burning coal of the cigarette. The second active component is an oxygen storage and donor metal oxide oxidation catalyst which performs a dual function: releases oxygen at free-burn rate temperatures adjacent a burning coal and acts as an oxidation catalyst. Such released oxygen performs at least the functions of:

i) compensating for the treatment material reducing rate of oxygen diffusion to a burning coal to ensure thereby the conventional free-burn rate; and ii) contributing to the oxidation treatment of components of the sidestream smoke.

The adjunct may be any suitable essentially non-combustible, finely divided, porous particulate material which does not affect the flavour and taste of the mainstream smoke and does not give off any undesirable odours in the sidestream vapours. The adjunct is physically stable at the elevated temperatures of the burning cigarette coal. The adjunct has a high surface area, usually in excess of about 20 $m^2/g$ of adjunct. In order for the particles to achieve such surface areas, they must be porous. Preferably, the porous adjunct has pores with an average diameter of less than 100 nm (1000 Å). More preferably, the pores have an average diameter of less than 20 nm (200 Å) and even more preferred are pores with an average diameter of 0.5 to 10 nm (5 to 100 Å). With zeolite based materials, the pores have an average diameter in the range of about 0.5 to 1.3 nm (5 to 13 Å).

It is preferred that the particulate adjunct has an average particle size of less than about 30 $\mu$m, more preferably less than about 20 $\mu$m and most preferably about 1 $\mu$m to 5$\mu$m. Non-combustible materials may be porous clays of various categories commonly used in cigarette paper manufacture, such as the bentonite clays or treated clays having high surface areas. Non-conbustible carbon materials may also be used including milled porous carbon fibres and particulates. Various metal oxides may be used such as porous monolithic mineral based materials which include zirconium oxide, titanium oxides, cerium oxides, aluminum oxides such as alumina, metal oxide fibres such as milled zirconium fibres, and other milled porous ceramic fibres and mixtures thereof, such as zirconiumlcerium fibres. In respect of cerium oxide, it has been found that it is capable of functioning as a finely divided adjunct and as an oxygen storage and donor cerium oxide oxidation catalyst. Other adjunct materials include high surface area materials such as activated carbon and zeolites.

The adjunct may also comprise high surface area sorptive materials which are non-combustible, finely divided porous particulates, such as activated carbon, molecular sieves, such as zeolites and amorphous materials such as silica/alumina and the like. The most preferred are zeolites such as silicalite zeolites, X, Y and L zeolites, faujasites ($(Na_2, Ca, Mg)_{29}[Al_{58}Si_{134}O_{384}].240\ H_2O$; cubic), β-zeolites ($Na_n[Al_nSi_{64-n}O_{128}]$ with n<7; tetragonal), Mordenite zeolites ($Na_8\ [Al_8Si_{40}O_{96}].24\ H_2O$; orthorhombic), ZSM zeolites ($Na_n[Al_nSi_{96-n}O_{192}]$~16 $H_2O$ with n<27; orthorhombic), and mixtures thereof. Preferred zeolites include hydrophobic zeolites and mildly hydrophobic zeolites which have affinity for hydrophobic and mildly hydrophobic organic compounds of such sidestream smoke. The zeolite materials provide a highly porous structure which selectively absorbs and adsorbs components of sidestream smoke. The highly porous structure generally comprise macropores amongst the particles and micropores within the particles, which branch off of the macropores. It is believed that the captured components in the macropores and micropores, in the presence of the cerium oxide or other suitable oxidation catalysts at the high temperature of the burning cigarette, converts such captured components into oxidized compounds which continue to be trapped in the adsorbed material or are released as invisible gases which have sufficiently low tar and nicotine levels so that the sidestream smoke is invisible or at a low, desired, level.

The zeolite materials may also be characterized by the following formula:

$$M_mM'_nM''_p[aAlO_2 \cdot b\ SiO_2 \cdot cTO_2]$$

wherein

M is a monovalent cation,

M' is a divalent cation,

M" is a trivalent cation, a, b, c, n, m, and p are numbers which reflect the stoichiometric proportions, c, m, n or p can also be zero, Al and Si are tetrahedrally coordinated Al and Si atoms, and T is a tetrahedrally coordinated metal atom being able to replace Al or Si, wherein the ratio of b/a of the zeolite or the zeolite-like material, has a value of about 5 and up to about 300, and the micropore size of the zeolite is within the range of about 0.5 to 1.3 nm (5 to 13 Å).

It is appreciated that various grades of the sorptive material may be used. This is particularly true with gradients of zeolites, which can be custom designed to selectively adsorb high boiling point materials, mid boiling point materials and low boiling point materials. This can lead to layers of the zeolite composition where the cerium or other suitable catalyst contemplated by this invention is preferably dispersed throughout these layers. The layers may then be bound on the tube, or wrap, by using binder or adhesive which may be, for example, polyvinylacetate, polyvinyl alcohol, starches and casein or soya proteins, and mixtures thereof.

The oxygen storage and donor metal oxide oxidation catalyst is provided in situ of the material and/or applied to at least one surface of the treatment material. The oxygen storage and donor metal oxide oxidation catalyst is preferably a metal oxide having multiple oxidation states. It is appreciated that the catalyst may be a precursor of the metal oxide which, at the temperature of the burning cigarette, is converted to a metal oxide capable of performing its catalytic activities. The metal oxide is most preferably selected from the transition metal oxides and rare earth metal oxides series of catalysts and mixtures thereof. The transition metal oxides may be selected from oxides of the group of metals consisting of IVB, VB, VIB, VIIB, VIII and IB metals and mixtures thereof. The preferred metal oxides from the transition metal group are the oxides of iron, copper, silver, manganese, titanium, zirconium, vanadium and tungsten. The rare earth metal oxides may be selected from scandium, yttrium and the lanthanide metal oxides.

Metals or metal oxide oxidation catalysts may also be used in conjunction with the oxygen storage and donor metal oxide oxidation catalysts. Such metal oxidation catalysts include precious metals, metals from groups IIA, IVA and mixtures thereof. Examples include tin, platinum, palladium and mixtures thereof.

The preferred oxygen storage and donor metal oxide oxidation catalyst of the lanthanide metal oxides, is cerium based and in particular, cerium oxide. This catalyst not only functions very well in expediting oxidation of captured organic materials but as well performs the desired additional function of oxygen storage and release in oxygen deprived environments. The catalytic material in the form of cerium oxide ($CeO_2$) when in the cool state is capable of retaining oxygen but when elevated in temperature releases oxygen upon thermal conversion to ceric oxide ($Ce_2O_3$). As the burning coal advances along the tube of the treatment material, the catalytic material releases oxygen at the elevated temperatures to maintain conventional free-burn rate of the cigarette. In addition, the released oxygen also supports the catalytic oxidation of the captured sidestream smoke components.

As mentioned above, the oxygen storage and donor metal oxide oxidation catalyst may be in its metal oxide form or a precursor of the metal oxide which, at the temperature of the burning cigarette, is converted to a metal oxide to perform its catalytic activities. The cerium catalyst precursor may be in the form of a cerium salt such as a cerium nitrate or other dispersible forms of cerium which is applied in solution or sol to the sorptive material and which is converted to cerium oxide at the high temperature of the burning cigarette to then function as a catalyst. For purposes of describing the invention, the term catalyst is intended to include any catalyst precursor.

The catalyst, such as cerium oxide, is used in combination with the adjunct material. It has been found that when the two are used separate from one another or in spaced apart, non-adjacent layers, the ability to control sidestream smoke is greatly reduced. Although in certain arrangements, some sidestream smoke control can be achieved. Preferably the catalyst is substantially adjacent the adjunct material. This can be achieved by co-mingling the particulate catalyst, in admixture with the adjunct, contacting a layer of the adjunct with a catalyst layer, coating the catalyst on the adjunct or impregnating the catalyst within or on the porous surfaces of the adjunct, to bring about the desired surprising sidestream smoke control properties. It should be appreciated that many other constituents may be used in addition to the combination of the oxygen storage and oxygen donor metal oxide oxidation catalyst and the adjunct. Additional additives may be used to further enhance the treatment of the sidestream smoke or alter other characteristics of the cigarette. Such additional additives may be mixed in with the treatment composition or used elsewhere in the cigarette construction, providing of course that such additives do not appreciably impact negatively on the ability of the treatment composition to treat the sidestream smoke. In specific embodiments, the composition may be formulated in a variety of ways, which achieve co-mingling of cerium with the adjunct material. For example, the adjunct material may be sprayed or dipped in a cerium salt solution such as cerium nitrate or cerium sol to impregnate the surface of the adjunct material with cerium. Cerium oxide may be prepared as a separate fine powder which is mixed with the fine powder of the adjunct material. It is particularly preferred that the powders have an average particle size of less than about 30 $\mu$m and preferably less than 20 $\mu$m and most preferably of about 1 $\mu$m to 5 $\mu$m to ensure intimate mixing and co-mingling of the materials.

As a general guide to selecting catalyst particle size and surface area, it is appreciated by one skilled in the art that the selected catalyst has a surface area which is such to ensure that the catalyst action sites are available to the migrating sidestream smoke components. This may result in catalyst particle size being greater than 30 $\mu$m, in certain embodiments, if the catalyst particles are properly distributed to achieve the necessary degree of sidestream smoke component oxidation.

It has been surprisingly found that the cerium oxide is one of the few oxides which can perform both functions of the invention, namely as an oxygen storage and donor metal oxide oxidation catalyst and as an adjunct. The porous cerium oxide particles can achieve the surface areas and particle size required for the adjunct. The cerium oxide is used in a first amount as the catalyst and a second amount as the adjunct in the treatment composition. Such amounts of the cerium oxide correspond generally with the amounts used for the catalyst and adjunct in accordance with other aspects of the invention to make up the total loading.

The cerium may be formulated as a solution dispersion, such as a cerium oxide sol, or the like, and applied to the adjunct material, such as zeolite. It is then dried and fired to provide cerium oxide on the surfaces of the adjunct material. When the cerium oxide particles are fixed to adjunct surfaces, such as surfaces of zeolite, the average particle size may be less than 1 $\mu$m. The relative amounts of cerium oxide fixed to the zeolite may range from about 1% to 75% by weight based on the total equivalent cerium oxide and zeolite content. The preferred relative amounts of cerium oxide fixed to the zeolite may range from about 10% to 70% by weight based on the total equivalent cerium oxide and zeolite content.

A preferred method for making the combination product of cerium oxide fixed on the surfaces of the zeolite is described in a co-pending U.S. provisional patent application Ser. No. 60/318,878 filed Sep. 14, 2001, entitled "A Process For Making Metal Oxide-Coated Microporous Materials" the subject matter of which is incorporated herein by reference.

Although a detailed specification for the manufacture of the combination product is provided in the above application, for ease of reference, the method generally involves making a catalytic cerium oxide-coated zeolite particulate material having at least 1% by weight of cerium oxide coated on outer surfaces of the zeolite particulate material, based on the total equivalent cerium oxide and zeolite content. In one aspect, the method generally comprises the steps of:

i) combining an amount of a colloidal dispersion of cerium oxide hydrate with a compatible zeolite particulate material to form a slurry, the amount of the colloidal dispersion being sufficient to provide, when heat treated as per step (ii), greater than 20% by weight of the cerium oxide, the zeolite particulate material having an average pore size of less than 20 Å and the colloidal dispersion having an average particle size of at least 20 Å, to position thereby, the colloidal dispersion on the outer surfaces of the zeolite; and ii) heat treating the slurry firstly, at temperatures below about 200° C. and secondly, above about 400° C., to fix the resultant cerium oxide on the outer surfaces of the zeolite particulate material, to provide a free flowing bulk particulate.

This product is available from AMR Technologies, Inc. of Toronto, Canada. Alternatively to this method, the adjunct sorptive material may be dipped in a solution of cerium salt and dried and heat treated to form the cerium oxide on the surfaces of the sorptive material.

The oxygen storage and donor metal oxide oxidation catalyst is capable of releasing oxygen at elevated temperatures, usually above 300° C. Surprisingly, it has been found that the donated oxygen functions, most appropriately, in the oxygen deprived environment around the burning coal. Although the treatment material, having a porosity less than about 200 Coresta units and usually less than 30 Coresta units, allows low amounts of air to diffuse to the burning coal, the oxygen donated by the oxygen storage and donor metal oxide oxidation catalysts supplies sufficient oxygen to ensure a conventional free-burn rate. This was quite unexpected. A treatment material, having a porosity less than about 200 Coresta units, and typically, in the range of about 0.5 to 30 Coresta units, with the oxygen storage and donor metal oxide oxidation catalysts and adjunct in combination, is sufficient. The oxidation of sorbed sidestream smoke components are at a suitable rate to ensure that visible components are not released from the material. Any components which might be visible on leaving the material to atmosphere are either further converted to non-visible components or are captured in the material by sorption. It is appreciated that the material may be used as a double or multiple wrap. The material may be applied as an outer wrap over a cigarette having conventional cigarette paper. It is also appreciated that depending upon the porosity, certain combinations of the catalyst and adjunct work better than others.

The non-combustible treatment material may, in combination with the oxygen storage and donor metal oxide oxidation catalysts and adjunct, comprise any suitable essentially non-combustible paper which does not affect the flavour and taste of the mainstream smoke and does not give off any undesirable odours in the sidestream vapours. Such non-combustible treatment material as formed into paper, having various porosities, may comprise clays of various categories commonly used in cigarette paper manufacture, such as the bentonite clays or treated clays having low surface areas. Non-combustible carbon material, such as carbon fibres, and ceramic material, such as ceramic fibres, may also be used. The non-combustible paper is physically stable at the elevated temperatures of the burning cigarette coal.

The non-combustible treatment material is preferably made into a sheet where the sheet may have a thickness normally in the range of about 0.04 mm up to about 2 mm but preferably not exceeding about 1 mm in thickness. The sheet may be made by standard continuous papermaking processes without heat treatment or by processes involving heat treatment such as described in aforementioned U.S. Pat. No. 4,915,117, the subject matter of such process being incorporated herein by reference. A slurry composition is made up which includes the inorganic non-combustible active materials, non-combustible fillers and other combustible organic components. The slurry composition is formed into a precursor sheet which is then aged at an elevated temperature to evaporate the organics and develop thereby a porous structure for the sheet having a porosity that is less than about 200 Coresta units. Unlike non-combustible, high porosity materials, the material having a porosity that is less than about 200 Coresta units requires a lower concentration of organics to achieve this porosity. In another embodiment, a very high porosity, non-combustible paper (greater than 200 Coresta units) can be used to make the non-combustible treatment material. The very high porosity, non-combustible paper may be coated with the treatment composition, filling the pores and resulting in a lower porosity treatment material that has a porosity less than about 200 Coresta units. Subsequently, a low porosity, non-combustible paper may be coated with the treatment composition, filling the pores and resulting in an even lower porosity treatment material, for example, having a porosity of from about 0.5 to about 30 Coresta units.

It is appreciated that the non-combustible treatment material may be designed by virtue of altered thickness, altered pore size or the like to permit some sidestream smoke to permeate through the tube. This action may be desirable when the smell of a trace of sidestream smoke at the tube surface is desired by the smoker. The non-combustible treatment material is designed preferably for one time use only and then discarded. This feature optimizes the design from the standpoint of tube thickness where a minimal thickness is required to prevent sidestream smoke breakthrough on a single use basis.

To make the treatment material, the treatment composition of oxygen storage and donor metal oxide oxidation catalyst and adjunct may be simply sprayed on in accordance with standard techniques both sides or either side of a non-combustible substrate which may be in sheet, wrapper or paper form. As shown in FIG. 1, the substrate 10 is conveyed in the direction of arrow 12. The composition 14 is sprayed as a slurry by spray nozzle 16 onto the substrate 10 to provide a coating 18 which is dried on the substrate.

Figure 2:
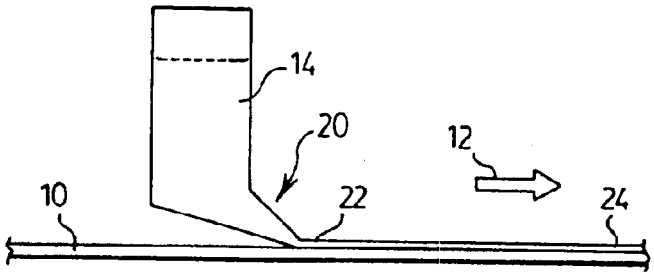
FIG. 2 is a schematic view of extruding a film of the treatment composition onto the non-combustible paper.
Figure 3:
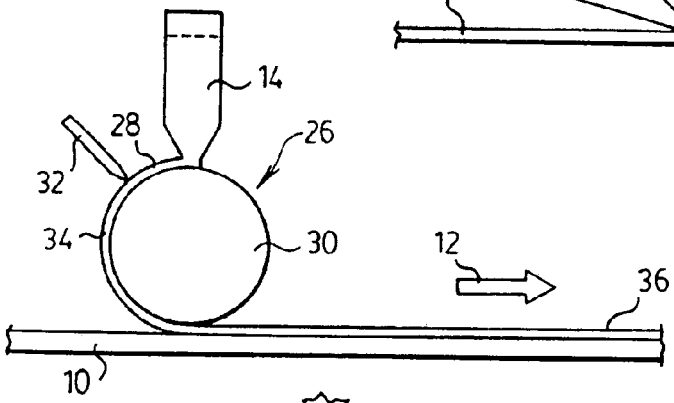
FIG. 3 is a schematic view of roll coating the treatment composition onto the non-combustible paper.

Alternatively, the composition may be extruded as a film onto the surface of both sides or either side of the non-combustible substrate. As shown in FIG. 2, a film coating device 20 contains the slurried treatment composition 14. The film coater 20 lays a thin film 22 on the substrate 10 which is conveyed in the direction of arrow 12. The film is dried to provide a coating 24 on the substrate 10. The coating may also be achieved by a roller applicator 26, as shown in FIG. 3. The slurried treatment composition 14 is applied as a layer 28 on the roller 30. A doctor knife 32 determines the thickness of a layer 34 which is then laid onto the substrate 10 which is conveyed in the direction of arrow 12. The layer is then dried to form a coating 36 on the substrate 10.

Figure 4:
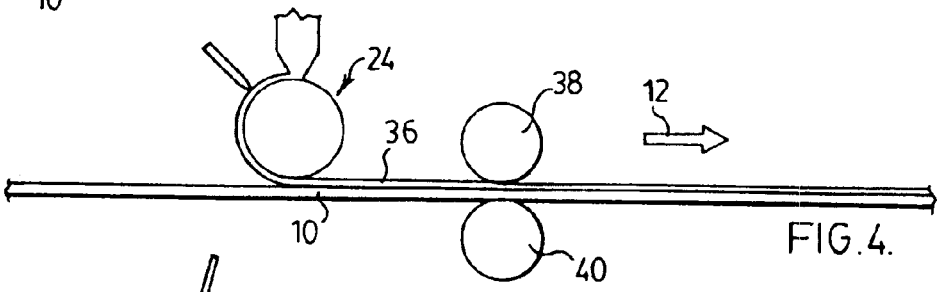
FIG. 4 is a schematic view of impregnation of the treatment composition into the non-combustible paper.

Also, the composition can be impregnated on both sides or either side of the non-combustible substrate. Impregnation is achieved by using the coating roller 24 of FIG. 4 and the resultant layer 36 with substrate 10 is passed in the direction of arrow 12 through pressure rollers 38 and 40 which force the layer of composition into the substrate 10 to thereby impregnate constituents of the treatment composition into the substrate.

It is also understood by one of skill in the art that various other coating processes, including transfer coating processes, may be used for making the treatment material of the invention. In the transfer coating process, a Mylar™ sheet or other suitable sheet may be used to transfer a coating composition from the Mylar™ sheet to the surface of the substrate. This type of transfer coating is useful when the substrate sheet may not readily accept the roll coating of a composition due to physical strength characteristics of the paper or the like.

Figure 5:
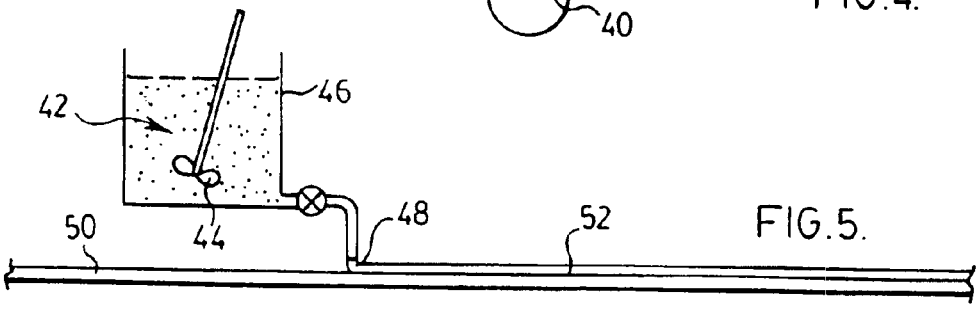
FIG. 5 is a schematic view of mixing the treatment composition with the non-combustible paper pulp in the manufacture of the non-combustible paper.

A further alternative is to incorporate the treatment composition into the manufacture of the non-combustible sheet or the like. The composition may be introduced to the substrate furnish as a slurry. With reference to FIG. 5, the treatment composition in the furnish 42 is stirred by stirrer 44 to form a slurry in the tank 46. The slurry is transferred in the conventional substrate making manner and is laid as a layer 48 on a moving conveyor 50 to form the resultant cigarette paper 52. As a result the treatment composition is incorporated in the final treatment material which may be a paper product. Another alternative is to sandwich the treatment composition between non-combustible substrate layers to form a double cigarette paper wrap on tobacco rods. For example, the composition may be applied such as by spraying of FIG. 1 on the interior of the outer substrate or the exterior of the inner substrate. Once the two substrates are applied to the tobacco rod the composition as a layer is sandwiched between the two substrates. Each substrate may be of half of the thickness of conventional cigarette paper so that the double wrap does not add appreciably to the overall diameter of the cigarette as is readily handled by cigarette making machines.

Figure 6:
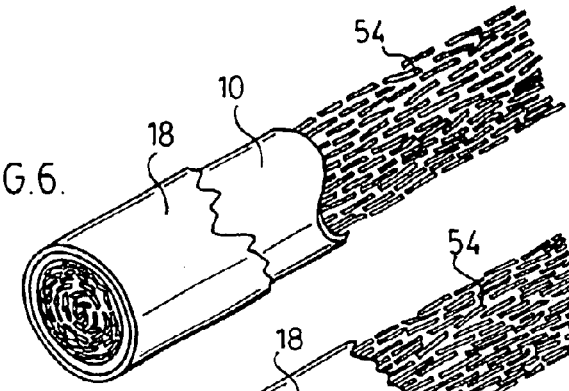
FIG. 6 is a perspective view of a tobacco rod having the treatment paper of this invention applied thereto.
Figure 7:
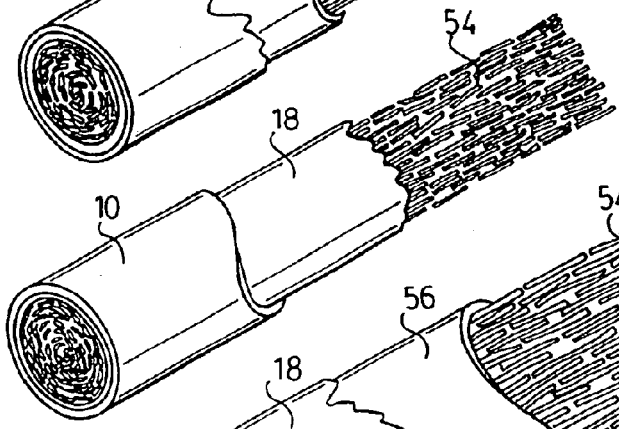
FIG. 7 shows an alternative embodiment of FIG. 6.

With reference to FIG. 6, the tobacco rod 54 has, for example, the non-combustible treatment material as a paper 10 wrapped therearound with the coating 18 on the outside of the paper. Conversely, as shown in FIG. 7, the non-combustible, paper 10 can be applied with the coating 18 on the inner surface of the paper adjacent the tobacco rod 54.

Figure 8:
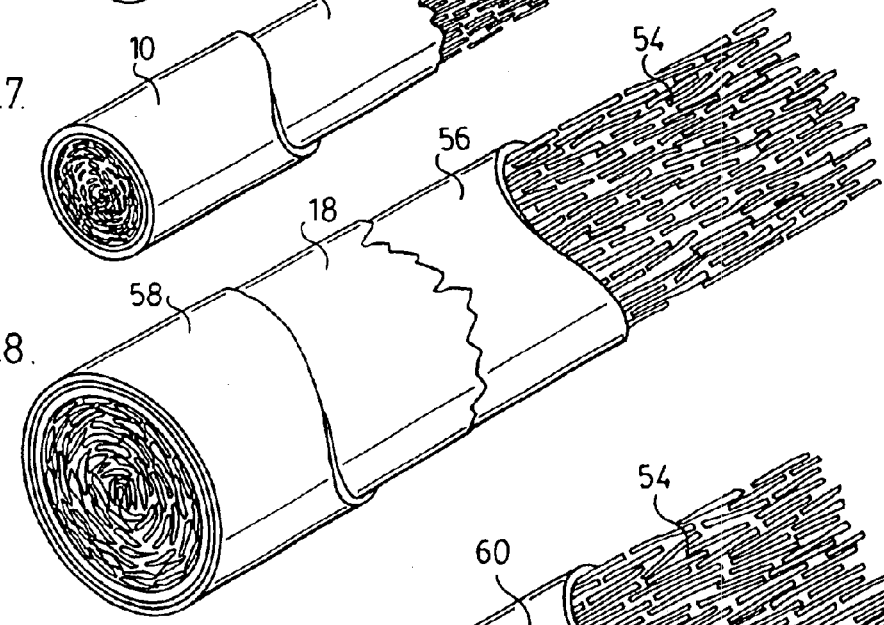
FIG. 8 is a perspective view of a tobacco rod having the treatment composition sandwiched between two layers of the non-combustible paper as applied to the tobacco rod.
Figure 9:
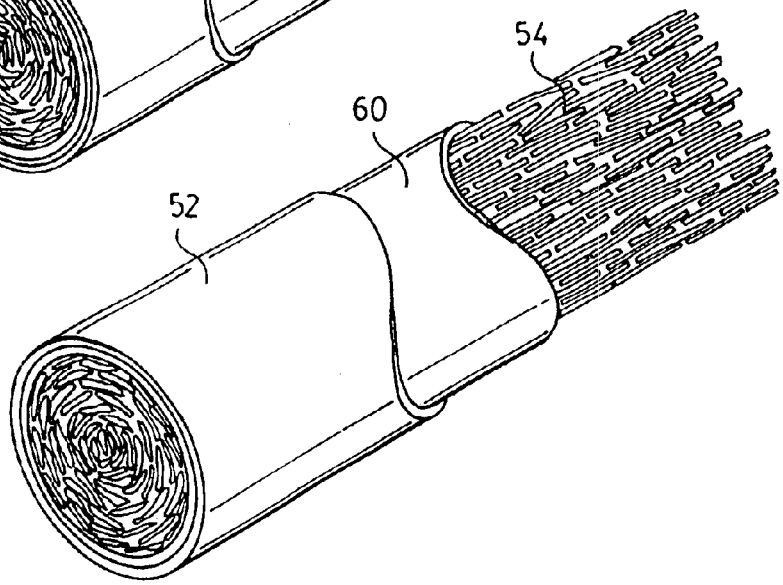
FIG. 9 is a perspective view of a double wrap for the tobacco rod where non-combustible treatment material is applied over conventional cigarette paper.

Another alternative, as shown in FIG. 8 and as previously discussed, is to sandwich the coating 18 between non-combustible papers 56 and 58. The papers 56 and 58 with the intermediate coating 18 may be formed as a single cigarette wrapper which is applied to the tobacco rod 54. A further alternative is shown in FIG. 9 where the tobacco rod 54 is covered with conventional cigarette paper 60. Over the conventional paper 60 is the non-combustible treatment paper 52 of FIG. 5 with the treatment composition incorporated therein. It is appreciated also that treatment paper 52 may be applied directly to the tobacco rod 54.

As is appreciated by one of skill in the art, the aforementioned procedures for providing the sidestream smoke treatment composition within or onto a wrap may be varied with respect to the loadings provided and the number of wraps used on a tobacco rod. For example, two or more wraps with various loadings of the composition, on both sides of the wraps, may be used such that the loading to one side is reduced, making coating application easier.

With any of these combinations, it has been surprisingly found that sidestream smoke is virtually eliminated. At the same time, the cigarette paper of the conventional cigarette, as shown in FIG. 9, demonstrates conventional ashing characteristics even though the non-combustible paper has a porosity less than about 200 Coresta units.

In respect of prior art devices which provide a tubular material or wrap placed on the cigarette, there is usually an additional paper material or the like applied to the exterior of the tube to provide the necessary control on oxygen diffusion to decrease free-burn rate and hence, give off less sidestream smoke. Contrary to this, applicant's invention provides a treatment material in the form of a tube or wrap which allows the conventional cigarette to burn at conventional free-burn rates and give off sidestream smoke in a normal manner including that generated by the cigarette paper. Also, the applicant's invention provides a treatment material that may be substituted for the cigarette paper of the conventional cigarette and allow the tobacco to burn at conventional free-burn rates and give off sidestream smoke in a normal manner. The treatment material treats the sidestream smoke components externally of the cigarette paper (or tobacco, in the substitution case) and decoupled from of the mainstream smoke being generated. This decoupling of the treatment activities from the mainstream smoke production ensures that sidestream smoke components do not permeate back into the mainstream smoke to affect appreciably mainstream smoke flavour and taste nor introduce into the mainstream smoke a significant amount of constituents which are normally not there in smoking a cigarette freely. The sidestream smoke components may be sorbed by the treatment material, treated and then allowed to permeate outwardly to atmosphere. There is nothing in the physical structure of the treatment material which would direct the treated components and resultant reaction products back into the cigarette tobacco thereby avoiding any significant alteration to taste and flavour of the mainstream smoke.

It is appreciated that depending upon the manner in which the treatment composition is used and applied to the non-combustible substrate, various processing aids and mixtures thereof may be required to facilitate the particular application of the treatment composition. Such processing aids include laminating materials such as polyvinylalcohol, starches, carboxy methyl cellulose (CMC), casein and other types of acceptable glues, various types of binding clays, inert fillers, whiteners, viscosity modifying agents, inert fibrous material such as zirconium fibres and zirconium/cerium fibres such as described in U.S. provisional patent application Ser. No. 60/318,614. filed Sep. 13, 2001, entitled "Zirconium/Metal Oxide Fibres" the subject matter of which is incorporated hereby by reference. Penetrating agents may also be employed to carry the composition into the non-combustible substrate. Suitable diluents such as water are also used to dilute the composition to form a slurry so that it may be spray coated, curtain coated, air knife coated, rod coated, blade coated, print coated, size press coated, roller coated, slot die coated, technique of transfer coating and the like onto a non-combustible substrate.

Desirable loadings of the composition onto or into the non-combustible, treatment material is preferably in the range of from about 2.5 $g/m^2$ to about 125 $g/m^2$. Most preferably the loading is in the range of about 2.5 $g/m^2$ to about 100 $g/m^2$. Expressed as a percent by weight, the non-combustible treatment material may have from about 10% to 500% by weight and most preferably, about 10% to 400% by weight of the treatment composition. While these loadings are representative for single wraps, it is understood by one skilled in the art that these total loadings may be provided with the use of two or more wraps.

The sidestream smoke reduction composition is used normally as a water slurry of the composition. The slurry may be incorporated in the furnish of the non-combustible wrapper in the wrapper making process, or is coated onto the wrapper by various coating processes or impregnated into the wrapper by various impregnating methods as discussed previously. The preferred average particle size for the slurry is in the range of about 1 $\mu$m to about 30 $\mu$m and most preferably about 1 $\mu$m to about 5 $\mu$m. The preferred relative amounts of catalyst fixed to the adjunct may range from about 1% to 75%, more preferably from about 10% to 70%, and even more preferably from about 20% to 70% by weight based on the total equivalent catalyst and adjunct content.

EXAMPLES

The efficacy of various embodiments of the invention for treating sidestream smoke is demonstrated in the following examples. It is not intended, however, that the following examples are in any way limiting to the breadth of the appended claims.

Example 1

The treatment material, in the shape of a tube, was placed on and in substantial contact with the cigarette paper of a conventional cigarette. Compositions for the treatment material are found in TABLE 1. Each sample listed in TABLE 1 contains the following:

15 wt % Processing Additives 40 wt % Filler Clay 10 wt % Calcium Silicate 5 wt % Bonding Clay 20 wt % Zeolite 10 wt % Cerium Hydrate (Impregnated)

100 wt % Total plus 5 wt % Cerium Hydrate (Coating)

TABLE 1

| Sample | Porosity (Coresta Units) |
|---|---|
| 1 | 11.7 |
| 2 | 10.0 |
| 3 | 9.8 |
| 4 | 7.6 |
| 5 | 8.3 |
| 6 | 7.0 |
| 7 | 10.1 |

The prepared cigarettes were smoked in a standard smoking machine. The amount of sidestream smoke was quantified visually on a scale of 0 to 8, 0 being no sidestream smoke and 8 being sidestream smoke as generated by a conventional cigarette. The results for the samples of Table 1 are provided

TABLE 2

| Sample | Puffs | Sidestream-Visual (0–8) |
|---|---|---|
| 1 | 9.3 | 0.3 |
| 2 | 9.3 | 1.4 |
| 3 | 10.7 | 0.3 |
| 4 | 9.7 | 0.2 |
| 5 | 9.3 | 0.9 |
| 6 | 10.7 | 0.9 |
| 7 | 9.7 | 1.2 |

The test results of Table 1 are based on an average of 3 cigarettes measuring the number of puffs of each cigarette, the sidestream smoke emitted and pressure drop. The test results clearly indicate that all compostions 1 through 7 work satisfactorily in that the visual rating of 2 or less for sidestream smoke reduction is considered acceptable. Readings of around 1.2 or less are considered to be exceptional. Readings of less than 1 indicates an almost imperceptible stream of sidestream smoke.

Example 2

The treatment material, in the shape of a tube, was placed on and in substantial contact with the cigarette paper of a conventional cigarette. Compostions for the treatment material are found in TABLE 3. Each sample listed in TABLE 3 contains the following:

15 wt % Processing Additives 41 to 47 wt % Filler Clay 4 to 10 wt % Calcium Silicate 5 wt % Bonding Clay 20 wt % Zeolite 10 wt % Cerium Hydrate (Impregnated)

100 wt % Cerium Hydrate (Coating)

TABLE 3

| Sample | Porosity (Coresta Units) |
|---|---|
| 1 | 21.4 |
| 2 | 9.7 |
| 3 | 7.1 |
| 4 | 10.9 |

TABLE 3-continued

| Sample | Porosity (Coresta Units) |
|---|---|
| 5 | 12.3 |
| 6 | 13.3 |

The prepared cigarettes were smoked in a standard smoking machine. The amount of sidestream smoke was quantified visually on a scale of 0 to 8, 0 being no sidestream smoke and 8 being sidestream smoke as generated by a conventional cigarette. The results for the samples of Table 3 are provided as follows in Table 4.

TABLE 4

| Sample | Puffs | Sidestream-Visual (0–8) |
|---|---|---|
| 1 | 7 | 0.2 |
| 2 | 8.3 | 0.2 |
| 3 | 7 | 0 |
| 4 | 7.6 | 0.4 |
| 5 | 8 | 0.8 |
| 6 | 8 | 1.4 |

The test results of Table 4 are based on an average of 3 cigarettes measuring the number of puffs of each cigarette, the sidestream smoke emitted and pressure drop. The test results clearly indicate that all compositions 1 through 7 work satisfactorily in that the visual rating of 2 or less for sidestream smoke reduction is considered acceptable. Readings of around 1.2 or less are considered to be exceptional. Readings of less than 1 indicates an almost imperceptible stream of sidestream smoke.

Although preferred embodiments of the invention have been described herein in detail, it will be understood by those skilled in the art that variations may be made thereto without departing from the spirit of the invention or the scope of the appended claims

What is claimed is:

1. A cigarette unit comprising a cigarette with cigarette paper surrounding a tobacco rod and a non-combustible treatment material surrounding and being substantially in contact with said cigarette paper, said non-combustible treatment material comprising a sidestream smoke treatment composition, wherein said non-combustible treatment material has a porosity less than about 200 Coresta units and said treatment composition comprises, in combination, an oxygen storage and donor metal oxide oxidation catalyst and an essentially non-combustible finely divided porous particulate adjunct for said catalyst.

2. A cigarette unit of claim 1, wherein said treatment material is wrapped onto said cigarette paper to define a wrapper for said unit.

3. A cigarette unit of claim 1, wherein said treatment material is preformed into a tube having an inner diameter which receives the cigarette with the cigarette paper and is in frictional engagement therewith.

4. A cigarette unit of claim 1, wherein said treatment material has a porosity of from about 0.5 to about 30 Coresta units.

5. A cigarette unit of claim 1, wherein said adjunct has an average particle size of less than about 30 $\mu$m.

6. A cigarette unit of claim 5, wherein said adjunct is a high surface area material with a surface area in excess of 20 $m^2/g$ and an average particle size greater than 1 $\mu$m.

7. A cigarette unit of claim 6, wherein said adjunct is selected from the group consisting of clays, essentially non-combustible milled fibres, monolithic mineral based materials, essentially non-combustible activated carbon, zeolites and mixtures thereof.

8. A cigarette unit of claim 7, wherein said zeolite is selected from the group consisting of silicalite zeolites, faujasites, X, Y and L zeolites, beta zeolites, Mordenite zeolites, ZSM zeolites and mixtures thereof.

9. A cigarette unit of claim 7, wherein said non-combustible milled fibres are selected from the group consisting of zirconium fibres, zirconium/cerium fibres, ceramic fibres, carbon fibres and mixtures thereof.

10. A cigarette unit of claim 6, wherein said catalyst is a finely divided particulate with an average particle size less than 30 $\mu$m.

11. A cigarette unit of claim 6, wherein said catalyst has a particle size less than about 1 $\mu$m when said catalyst particles are fixed to surfaces of said adjunct.

12. A cigarette unit of claim 11, wherein the relative amounts of said catalyst fixed to said adjunct is ranges from about 1 to 75% by weight based on the total equivalent catalyst and adjunct content.

13. A cigarette of claim 12, wherein the relative amounts of said catalyst fixed to said adjunct ranges from about 20 to 70% by weight based on the total equivalent catalyst and adjunct content.

14. A cigarette unit of claim 1, wherein said catalyst is selected from the group consisting of transition metal oxides, rare earth metal oxides and mixtures thereof.

15. A cigarette unit of claim 14, wherein said transition metal oxides are selected from the group consisting of oxides of group IVB, VB, VIB, VIIB, VIII, IB metals and mixtures thereof.

16. A cigarette of unit claim 15 wherein said transition metal oxide is selected from the group consisting of oxides of iron, copper, silver, manganese, titanium, zirconium, vanadium and tungsten.

17. A cigarette unit of claim 16 wherein said transition metal oxide is iron oxide.

18. A cigarette unit of claim 14, wherein said rare earth metal oxides are selected from the group consisting of oxides of scandium, yttrium, lanthanide metals and mixtures thereof.

19. A cigarette unit of claim 18, wherein said lanthanide metal oxide is cerium oxide.

20. A cigarette unit of claim 19, wherein said cerium oxide is admixed with zeolite as said adjunct.

21. A cigarette unit of claim 19, wherein said cerium oxide is provided as a layer adjacent to a layer of zeolite.

22. A cigarette unit of claim 19, wherein said composition comprises cerium oxide particles fixed to surfaces of zeolite particles.

23. A cigarette unit of claim 19, wherein a metal or metal oxide oxidation catalyst is used with said cerium oxide, said metal or metal oxide being selected from the group of oxides of precious metals, transition metals, rare earth metals, metals from groups IIA, IVA, and mixtures thereof.

24. A cigarette unit of claim 23, wherein said selected metal or metal oxide is platinum, palladium, copper oxide, iron oxide, magnesium oxide, silver oxide, or mixtures thereof.

25. A cigarette unit of claim 1, wherein a first amount of cerium oxide in said treatment composition is said adjunct and a second amount of said cerium oxide in said treatment composition is said catalyst.

26. A cigarette unit of claim 1, wherein said treatment material comprises from about 10% to about 500% by weight of said treatment composition.

27. A cigarette unit of claim 1, wherein said treatment material comprises loadings of from about 2.5 g/m$^2$ to about 125 g/m$^2$ of said treatment composition.

28. A cigarette of claim 1, further comprising a processing aid selected from the group consisting of zirconium fibres and zirconium/cerium fibres.

29. A non-combustible cigarette material for use on a smokable tobacco rod of a cigarette for treating smoke emitted from a burning cigarette, said material having a porosity less than about 200 Coresta units and a treatment composition comprising, in combination, an oxygen storage and donor metal oxide oxidation catalyst and an essentially non-combustible finely divided porous particulate adjunct for said catalyst.

30. A cigarette material of claim 29, wherein said catalyst and said adjunct have an average particle size less than about 30 $\mu$m.

31. A cigarette material of claim 30, wherein said adjunct is selected from the group consisting of clays, essentially non-combustible milled carbon or ceramic fibres, monolithic mineral based materials, essentially non-combustible activated carbon, zeolites and mixtures thereof, and said catalyst is selected from the group consisting of transition metal oxides, rare earth metal oxides and mixtures thereof.

32. A cigarette material of claim 31, wherein said non-combustible milled fibres are selected from the group consisting of zirconium fibres, zirconium/cerium fibres, ceramic fibres, carbon fibres and mixtures thereof.

33. A cigarette material of claim 31, wherein said transition metal oxides are selected from the group consisting of oxides of group IVB, VB, VIB,VIIB, VIII, IB metals and mixtures thereof, and said rare earth metal oxides are selected from the group consisting of oxides of scandium, yttrium, lanthanide metals and mixtures thereof.

34. A cigarette material of claim 33, wherein said catalyst is cerium oxide and said adjunct is a zeolite.

35. A cigarette material of claim 33, wherein said treatment composition is incorporated with said paper from about 10% to about 500% by weight.

36. A cigarette material of claim 29 further comprising a processing aid selected from the group consisting of zirconium fibres and zirconium/cerium fibres.

* * * * *

UNITED STATES PATENT AND TRADEMARK OFFICE

CERTIFICATE OF CORRECTION

PATENT NO. : 6,904,918 B2
DATED : June 14, 2005
INVENTOR(S) : Stanislav M. Snaidr et al.

It is certified that error appears in the above-identified patent and that said Letters Patent is hereby corrected as shown below:

Column 18,
Line 44, delete "sidestream smoke".

Signed and Sealed this

Twenty-first Day of March, 2006

JON W. DUDAS
*Director of the United States Patent and Trademark Office*